US007586030B2

(12) United States Patent
Nishida

(10) Patent No.: US 7,586,030 B2
(45) Date of Patent: Sep. 8, 2009

(54) KEYBOARD APPARATUS

(75) Inventor: Kenichi Nishida, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 12/166,577

(22) Filed: Jul. 2, 2008

(65) Prior Publication Data

US 2009/0007757 A1 Jan. 8, 2009

(30) Foreign Application Priority Data

Jul. 2, 2007 (JP) ..... 2007-173865
Jul. 2, 2007 (JP) ..... 2007-173866

(51) Int. Cl.
*G10C 3/12* (2006.01)

(52) U.S. Cl. ..... 84/423 R

(58) Field of Classification Search ..... 84/423 R, 84/430–436
See application file for complete search history.

(56) References Cited

U.S. PATENT DOCUMENTS 2,835,157 A * 5/1958 Waters ..... 84/240
6,002,078 A * 12/1999 Yoshinaga et al. ..... 84/436
6,156,963 A 12/2000 Masubuchi

FOREIGN PATENT DOCUMENTS

JP 10-240229 9/1998

* cited by examiner

*Primary Examiner*—Kimberly R Lockett
(74) *Attorney, Agent, or Firm*—Morrison & Foerster LLP

(57) ABSTRACT

In a keyboard apparatus, a key unit has one or more key bodies, a key supporting part for supporting each key body, and a connecting part for connecting the key body to the key supporting part pivotably in a key-stroking direction of the key body. A key frame has an upper surface, and a key mounting part disposed on the upper surface for mounting the key supporting part of the key unit. The key supporting part of the key unit has a first engagement section having a hook-like structure or a press-fitting structure. The key mounting part of the key frame has a second engagement section which engages with the first engagement section when the key unit is mounted to the key frame. The second engagement section has a through-hole or a concave for engagement with the hook-like structure or the press-fitting structure of the first engagement section. The first engagement section and the second engagement section are located above the key mounting part of the key frame.

11 Claims, 11 Drawing Sheets

KEYBOARD APPARATUS

BACKGROUND OF THE INVENTION

1. Technical Field

This invention relates to a keyboard apparatus, and specifically relates to a keyboard apparatus which comprises a key unit provided with a plurality of key bodies, a key supporting part for supporting each key body and a connecting part connecting the key supporting part in a pivotable manner, which are provided integrally by means of synthetic resin, and a key frame on which a key mounting part for locking the key supporting part of the key unit is provided.

2. Background Art

A keyboard apparatus as shown in FIG. 17 is disclosed for example in Japanese Patent No. 3082696. As shown in the same drawing, a keyboard apparatus comprises a white key unit 10 and a black key unit 11 serving as key units, and a key frame 20. The white key unit 10 and the black key unit 11 are, respectively, provided with one or more of key body 12 for stroking operation, a key supporting part 13 supporting the far end of the key body 12 remote from a player in a depth direction Y1 of the key frame 20, and a connecting part 14 connecting the key body 12 to the key supporting part 13 in a pivotable manner in a key-stroking direction Y2. These parts are provided integrally by means of synthetic resin.

The key supporting parts 13 of the white key unit 10 and the black key unit 11, respectively, have a first screw hole 16 into which a screw N for mounting to the key frame 20 is inserted. The far side remote from a player of the key supporting part 13 of the black key unit 11 is provided with an arm section 13A extending toward the lower side of the key frame 20 and a first engagement section 13B provided at the lower end of the arm section 13A which projects toward the far side from a player.

The key frame 20 has an upper surface portion 22 and a first reinforcement rib 23. The upper surface portion 22 is provided like a plate approximately perpendicular to the key-stroking direction Y2. The far side of the upper surface portion 22 away from a player in the depth direction Y1 is provided with a key mounting part 22A to which the key supporting part 13 is locked.

The key mounting part 22A has a boss 21 extending toward the lower side, and the boss 21 has a second screw hole 21A. The second screw hole 21A has a thread groove to threadably mate with the screw N. The upper surface portion 22 disposed on the farther side than the key mounting part 22A from a play has an insertion hole 29 into which the first engagement section 13B is inserted. The first reinforcement rib 23 is provided at the lower side of the upper surface portion 22 of the key frame 20, and serves to reinforce the key mounting part 22A which not so strong against applied force.

Next, described below is the mounting work of the white key unit 10 and the black key unit 11 having the configurations as described above to the key frame 20. First, the key supporting parts 13 of two white key units 10 are placed with one laid on another so that their first screw holes 16 in the key mounting parts 13 are aligned. On them, the key supporting part 13 of a black key unit 11 is laid so that their first screw holes 16 are aligned.

Then, with the key supporting part 13 of one black key unit 11 are laid on those of two white key units 10, the first engagement section 13B of the black key unit 11 is inserted into the insertion hole 29. This engages the first engagement section 13B and a second engagement section 27A which is the edge portion of the far side of the insertion hole 29 away from a player, so that the white key units 10 and the black key unit 11 are temporarily fixed to the key frame 20. This temporary fixation aligns the first screw holes 16 in the key supporting part 13 of the white key unit 10 and the black key unit 11 with the second screw hole 21A in the key frame 20. Then, the screw N is inserted into the first screw holes 16 and threadably mated with the second screw hole 21A, and the key supporting parts 13 of the white key units 10 and the black key unit 11 are locked to the key mounting part 22A of the key frame 20.

However, the conventional configuration as shown in FIG. 17, which is provided with the first engagement section 13B projecting below the key mounting part 22A, has a problem of reducing space efficiency as well as the degree of freedom of mounting component parts such as a hammer, basal plate, cushion and speaker, if mounted below the key mounting part 22A.

In addition, the conventional configuration a shown in FIG. 17, which is provided with a boss 21 extending below a key mounting part 22A of a key frame 20, has a problem of reducing space efficiency as well as the degree of freedom of mounting due to the boss 21. It has further problem of interfering with the improvement of production efficiency which can be attained by using standardized screws N, because the screws N need to be longer than ordinary screws in order to be inserted into first screw holes 16 and second screw holes 21A provided both in the key supporting part 13 and the key frame 20.

The conventional configuration as shown in FIG. 17, which is provided with the first reinforcement rib 23 extending below the key mounting part 22A, has a problem of reducing space efficiency as well as the degree of freedom of mounting also due to the first reinforcement rib 23.

SUMMARY OF THE INVENTION

Therefore, it is an object of the present invention, upon focusing on the above-mentioned problems, to provide a keyboard apparatus having improved space efficiency and the degree of freedom of mounting.

To solve the above-mentioned problems, there is provided a keyboard apparatus comprising: a key unit that comprises one or more key bodies, a key supporting part for supporting each key body, and a connecting part for connecting the key body to the key supporting part pivotably in a key-stroking direction of the key body; and a key frame that comprises an upper surface, and a key mounting part disposed on the upper surface for locking the key supporting part of the key unit; wherein the key supporting part of the key unit has a first engagement section having a hook-like structure or a press-fitting structure; the key mounting part of the key frame has a second engagement section which engages with the first engagement section when the key unit is mounted to the key frame, the second engagement section having a through-hole or a concave for engagement with the hook-like structure or the press-fitting structure of the first engagement section; and the first engagement section and the second engagement section are located above the key mounting part of the key frame.

Preferably, the key supporting part has a first hole; the key mounting part has a projection provided on the upper surface of the key frame and extending toward the key supporting part, and a second hole provided on the projection; and a locking member is inserted into both the first hole and the second hole to lock the key supporting part and the key mounting part with each other.

Preferably, the key supporting part has a concave or a mating hole; the key mounting part has a projection provided on the upper surface of the key frame and extending toward the key supporting part; and the projection is inserted into the concave or the mating hole to lock the key supporting part and the key mounting part with each other.

Preferably, a plurality of the key units are arranged in a widthwise direction of the key frame; and the key frame has a reinforcement rib which extends toward the key unit and which is positioned in a gap created between the key supporting parts of the key units adjacent to each other in the widthwise direction and also created between the connecting parts belonging to the adjacent key units.

Preferably, the key frame is provided with a stopper member disposed adjacent to the second engagement section of the key mounting part of the key frame for restricting a pivotal movement of a hammer member coupled to the key body.

There is also provided a keyboard apparatus according to the invention, comprising: a key unit that comprises one or more key bodies, a key supporting part for supporting each key body, and a connecting part for connecting the key body to the key supporting part pivotably in a key-stroking direction of the key body; and a key frame that comprises an upper surface, and a key mounting part disposed on the upper surface for locking the key supporting part of the key unit; wherein the key supporting part of the key unit has a first hole; the key mounting part of the key frame has a projection provided on the upper surface of the key frame and extending toward the key supporting part, and a second hole provided on the projection; and a locking member is inserted into both the first hole and the second hole to lock the key supporting part and the key mounting part with each other.

In accordance with embodiments of the invention, since the first engagement section of the key supporting part and the second engagement section of the key mounting part are located above the key mounting part, and accordingly the first engagement section is prevented from being located below the key mounting part, space efficiency as well as the degree of freedom of mounting can be improved.

In accordance with the embodiments of the invention, since the projection projecting toward the key supporting part is provided at the key mounting part and the projection has the second hole for inserting a locking member, and accordingly the projection (boss) is prevented from projecting below the key mounting part, space efficiency as well as the degree of freedom of mounting can be further improved.

In accordance with the embodiments of the invention, since the projection provided on the upper surface of the key mounting part which projects toward the key supporting part is inserted into the concave or the mating hole on the key supporting part to lock the key supporting part and the key mounting part, and accordingly the projection is prevented from projecting below the key mounting part, space efficiency as well as the degree of freedom of mounting can be further improved.

In accordance with the embodiments of the invention, since the reinforcement rib is positioned in the gap between the key supporting part and the connecting part of one key unit and those of another key unit placed next to it, and accordingly the reinforcement rib is prevented from projecting below the key mounting part, space efficiency as well as the degree of freedom of mounting can be further proved.

DETAILED DESCRIPTION OF THE INVENTION

First Embodiment

Figure 1:
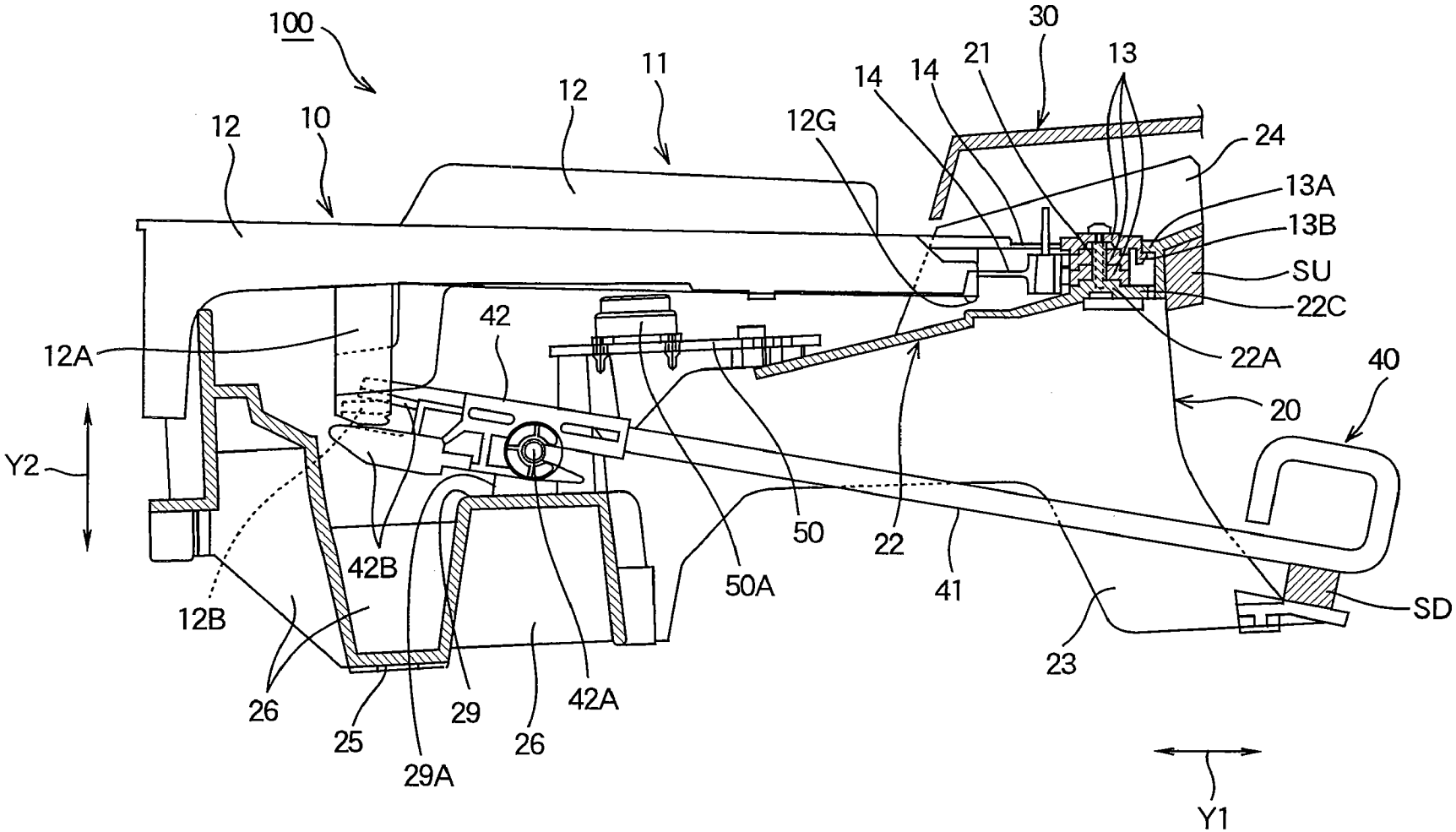
FIG. 1 is a cross-sectional view showing the first embodiment of a keyboard apparatus of the present invention.
Figure 2:
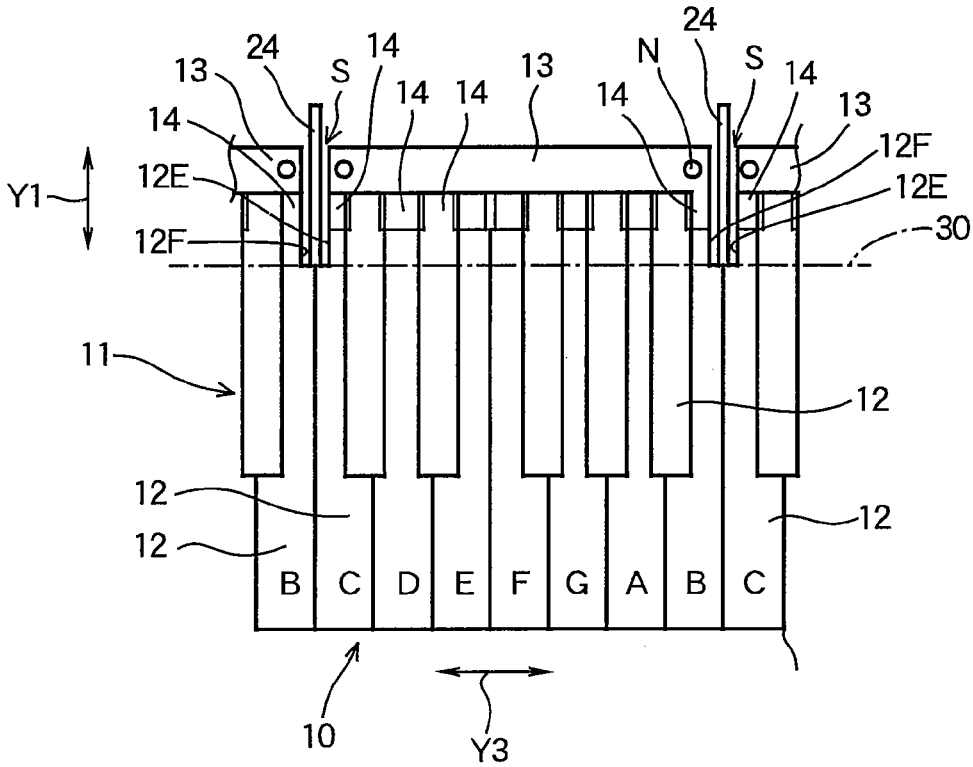
FIG. 2 is a top view of the keyboard apparatus as shown in FIG. 1, with the panel excluded.
Figure 3:
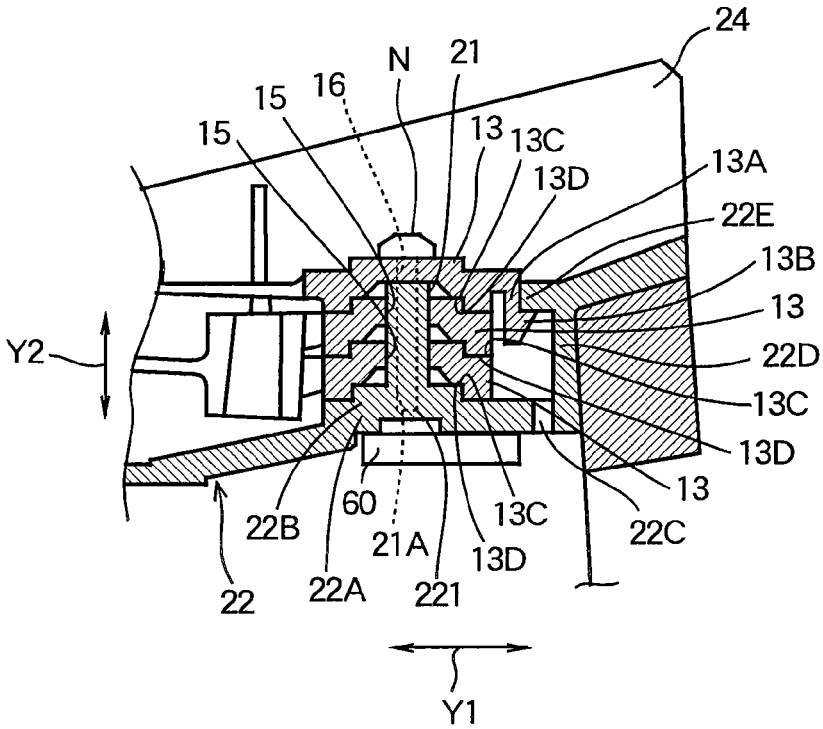
FIG. 3 is a partial enlarged view in the vicinity of the key supporting part and the key mounting part as shown in FIG. 1.

Described below is a first embodiment of the present invention, referring to the drawings. FIG. 1 is a cross-sectional view showing the first embodiment of a keyboard apparatus 100 of the present invention. FIG. 2 is a top view of the keyboard apparatus 100 shown in FIG. 1, with panel 30 excluded. FIG. 3 is a partial enlarged view in the vicinity of the key supporting part 13 and key mounting part 22A of the keyboard apparatus 100 shown in FIG. 1.

A keyboard apparatus 100, whose example is an electronic keyboard instrument, comprises a white key unit 10 and a black key unit 11 serving as key units, a key frame 20 formed of hard synthetic resin, and a hammer member 40, and a panel 30 is provided above as well as in the rear of the keyboard apparatus 100.

The white key unit 10 and black key unit 11 are, respectively, provided with one or more of key body 12 for stroking operation, a key supporting part 13 supporting the farther side of the key body 12 (the rear of the keys) away from a player in a depth direction Y1, and a connecting part 14 connecting the key body 12 to the key supporting part 13 in a key-stroking direction Y2 in a pivotable manner. These parts are provided integrally by means of synthetic resin.

The key body 12 is provided with a stopper projection 12G at the lower surface of the rear end thereof. This stopper projection 12G is provided for preventing the connecting part 14 having hinge structure from breaking, should the key body 12 be pressed strongly or should a younger child lean on the key body 12. The key supporting part 13 is provided in a lengthy form with its longitudinal direction extending along a widthwise direction Y3 of the key frame, as shown in FIG. 2, and respective key units 10 and 11 are provided as a common base shared by keys in a common manner. As shown in FIG. 3, the key supporting part 13 has a positioning convex portion 13C on the upper side and a positioning concave portion 13D on the lower side. The positioning convex portion 13C and the positioning concave portion 13D are provided so that the positioning convex portion 13C provided on the lower side of the key supporting part 13 is fit into the positioning concave portion 13D provided on the upper side of another key supporting part 13 when a plurality of key supporting parts 13 are stacked with each other in the key-stroking direction Y2. The positioning convex portion 13C and the positioning concave portion 13D facilitate the positioning between the key supporting parts 13. As shown in FIG. 1, the connecting part 14 is positioned between the key body 12 and the key supporting part 13, and is designed to be thin and to have elasticity, to constitute a hinge structure.

The keyboard apparatus 100 has two white key units 10 and one black key unit 11 per octave. In one of the two white key units 10, a single key supporting part 13 supports three key bodies 12 covering each note of D, F and A. In the remaining one of the two white key units 10, a single key supporting part 13 supports four key bodies 12 covering each note of C, E, G and B. In the black key unit 11, a single key supporting part 13 supports five key bodies 12 covering notes of C#, D#, F#, G# and A#.

These two white key units 10 and one black key unit 11 constitute one octave of keys with their key supporting parts 13 stacked on each other in the key-stroking direction Y2. A plurality of this one octave keys are arranged in the widthwise direction Y3 of the key frame. The key bodies 12 for C and B notes have cutouts 12E and 12F for creating a gap S extending between the key supporting part 13 and connecting part 14 of one white key unit 10 and those of another white key unit 10 placed next to it in the widthwise direction Y3. The gap S extends in the depth direction Y1 of the key frame toward a player side. The key supporting parts 13, connecting parts 14 and the cutouts 12E and 12F are covered with a panel 30 provided on the upper surface side of the key frame and thus not seen from the front.

As shown in FIG. 3, the white key units 10, respectively, have a mating hole 15 into which a boss (projection) 21 on the key frame 20, which is described later, is fit. On the contrary, the black key unit 11 has a first screw hole 16 into which a screw N serving as a locking member which is smaller than the mating hole 15 is inserted. Any or both of these mating hole 15 and screw hole 16 corresponds (or correspond) to a first hole as set forth in claims.

The key supporting part 13 of the black key unit 11 has an arm section 13A (see FIG. 9(A)) provided at the end of the farther side of the key supporting part away from a player in the depth direction Y1 and extending toward the lower side of the key-stroking direction, and a hook-like first engagement section 13B is provided at the end of the lower side in the depth direction Y2 of the arm section 13A and extending toward the farther side from a player in the depth direction Y1. The arm section 13A and the first engagement section 13B are provided at the key supporting part 13 which is laid at the top of other key supporting part 13 of a plurality of key units 10 and 11 stacked with each other on the key mounting part 22A. In this embodiment, the arm section 13A and the first engagement section 13B are provided so that the tip of the lower side thereof in the key-stroking direction Y2 is located above the key mounting part 22A on the upper surface portion 22 of the key frame with the key supporting part 13 of the black key unit 11 laid on the top of the key supporting parts 13 of the two white key units 10 (see FIG. 8).

The key frame 20 is mounted on the lower case not shown. Or the frame 20 itself may constitute a lower case. This key fame 20 has the upper surface portion 22, a first reinforcement rib 23 integrally formed with the depth direction Y1 below the upper surface portion 22, a second reinforcement rib 24 formed above the upper surface portion 22, a front section 25 and a third reinforcement rib 26, by means of synthetic resin. The upper surface portion 22 is provided to have a plate-like shape approximately perpendicular to the key-stroking direction Y2 and located on the farther side away from a player in the depth direction Y1 and upper side of the key-stroking direction Y2. The upper surface portion 22 is provided in a tapered shape where, the closer to the player side in the depth direction Y1, the closer to the lower side it becomes.

The farther side from a player in the depth direction Y1 of the upper surface portion 22 has the key mounting part 22A to which the key supporting part 13 is locked. The key mounting part 22A has a positioning convex portion 22B and a boss 21 provided on the positioning concave 22B, as shown in FIG. 3. The positioning convex portion 22B is provided so that it is fit into the positioning concave portion 13D when the key supporting part 13 is laid on the key mounting part 22A. The positioning convex portion 22B and the positioning concave portion 13D facilitate the positioning of the key supporting part 13 to the key mounting part 22A.

As shown in FIG. 3, the farther side from a player in the depth direction Y1 than the key mounting part 22A of the upper surface portion 22 is provided with a vertical wall section 22D extending in the key-stroking direction Y2 above the key mounting part 22A. Above the vertical wall section 22D, a second engagement section 22E projecting toward the player side in the depth direction Y1 is provided. That it, the second engagement section 22E is located above the key mounting part 22A. The opposing portion of the upper surface portion 22 facing the second engagement section 22E has a hole 22C for the prevention of undercut of the second engagement section 22E. This hole 22C serves to prevent interference between the upper surface portion 22 and the first engagement section 13B when the first engagement section 13B engages with the second engagement section 22E.

The above-mentioned boss 21 is provided, extending toward the upper side of the key-stroking direction Y2 of the key mounting part 22A, that is, toward the key supporting part 13. The boss 21 has a second screw hole 21A, which serves as a second hole into which a screw N described later is inserted. The second screw hole 21A has a thread groove to threadably mate with the screw N.

The lower surface of the key mounting part 22A is provided to have a plate-like shape having a concave groove 221 in the widthwise direction Y3. The lower surface of the key mounting part 22A is provided with a after-touch sensor 60. The after-touch sensor 60 serves as a sensor detecting a stroking pressure when the key body 12 is further pressed down after a normal key pressing, and is constituted by a resistor board having a resistor pattern with its resistance varying according to the pressure, a conductor board having a conductor pattern to be connected to the resistor pattern and a felt, which are laid on each other in this order. The sensor 60 detects contact pressure by bringing into contact with a key by means of the mass 41 of a hammer member 40 when a key is pressed.

As shown in FIG. 1, the first reinforcement rib 23 supports the lower side of the key-stroking direction Y2 of the upper surface portion 22, and reinforces the upper surface portion 22. The first reinforcement rib 23 is provided to have a plate-like shape approximately perpendicular to the widthwise direction Y3 and a plurality of the same ribs are arranged along the widthwise direction Y3 (between B and C keys as well as E and F keys).

The second reinforcement rib 24 serves as a reinforcement rib for reinforcing the upper surface portion 22. As shown in FIG. 2, the second reinforcement rib 24 is provided, extending toward the upper side of the key-stroking direction Y2 from the upper surface portion 22, so as to be positioned in a gap S between the key supporting part 13, connecting part 14 and key body 12 of one white key unit 10 and those of another white key unit 10 placed next to it. The second reinforcement rib 24 is provided to have a plate-like shape approximately perpendicular to the widthwise direction Y3 and a plurality of them are placed along the widthwise direction Y3.

The front section 25 is provided on the player side in the depth direction Y1 and at the lower side of the key-stroking direction Y2, and its cross-section has concave and convex surfaces. A third reinforcement rib 26 reinforces the front section 25. The third reinforcement rib 26 is provided to have a plate-like shape approximately perpendicular to the widthwise direction Y3, and a plurality of them are arranged along the widthwise direction Y3.

As shown in FIG. 1, the hammer member 40 is constituted by a mass 41 extending in the depth direction Y1 and a basal section 42 retaining the end of the mass 41, and is supported by a fulcrum supporting section 29A provided above the central convex portion 29 of the key frame 20. At the tip of the basal section 42, a connecting strip 42B splitting into upper and lower direction is formed, and mated with a connecting plate 12B provided at the lower end of the acting section 12A projecting toward the lower side from the key body 12.

When a key is pressed, the acting section 12A pushes down the basal section 42, and the hammer member 40 rotates counterclockwise in FIG. 1 around the rotating axis 42A; while, when a key is released, the acting section 12A pushes up the basal section 42 and the hammer member 40 rotates clockwise in FIG. 1 around the axis of rotation 42A. This contributes to giving a touch feeling like an acoustic piano. The key frame 20 is provided with stoppers SD and SU made of felt respectively at the lower end portion and the upper end portion, and these stoppers SD and SU serve to limit the rotating range of the hammer member 40. Namely, the key frame 22 is provided with the stopper member SU disposed adjacent to the engagement section 27A of the key mounting part 22A of the key frame 22 for restricting a pivotal movement of the hammer member 40 coupled to the key body 12.

A basal plate 50 is arranged between the white key units 10 and black key unit 11 and the hammer member 40, and a key switch 50A which is turned on/off when a key body 12 is released is mounted on the key switch 50A.

Next, described below is the mounting of the key units 10 and 11 to the key frame 20 in the keyboard apparatus 100 mentioned above. First, the boss 21 on the key frame 20 is mated with the mating hole 15 in the key supporting part 13 of the white key unit 10 consisting of four key bodies 12 covering each note of C, E, G and B and then that of the white key unit 10 consisting of three key bodies 12 covering each note of D, F and A in this order.

At this time, as shown in FIG. 3, the positioning concave portion 13D on the key supporting part 13 of the lower white key unit 10 is mated with the positioning convex portion 22B on the key mounting part 22A, and the positioning concave portion 13D on the key supporting part 13 of the upper white key unit 10 is mated with the positioning convex portion 13C of the key supporting part 13 of the lower white key unit 10, so that the white key units 10 are positioned at the key mounting part 22A.

The first engagement section 13B on the key supporting part 13 of the black key unit 11 is engaged with the second engagement section 22E on the vertical wall section 22D, so that the black key unit 11 is temporarily fixed to the key frame 20. At this time, the first engagement section 13B is engaged with the second engagement section 22E so that the positioning concave portion 13D on the key supporting part 13 of the black key unit 11 is mated with the positioning convex portion 13C on the key supporting part 13 of the upper white key unit 10. This temporary fixation aligns the second screw hole 21A on the boss 21 with the first screw hole 16 on the black key unit 11. Then the screw N is inserted into both the first screw hole 16 and the second screw hole 21A to lock the key supporting part 13 to the key mounting part 22A.

In accordance with the above-mentioned keyboard apparatus 100, since the first engagement section 13B on the key supporting part 13 and the second engagement section 22E on the key frame 20 are located above the key mounting part 22A, the first engagement section 13B on the key supporting part 13 is prevented from being located below the key mounting part 22A, and accordingly space efficiency as well as the degree of freedom of mounting can be improved. Specifically, since the first engagement section 13B is prevented from being located below the key mounting part 22A, the lower surface of the key mounting part 22A can be formed flat, which enables an after-touch sensor 60 can be arranged on the lower surface of the key mounting part 22A, as shown in FIG. 3.

In addition, since the first engagement section 13B is prevented from being located below the key mounting part 22A, when a mass 41 is located at the lower side of the key mounting part 22A, as shown in FIG. 1, the pivoting range of the mass 41 is not restricted by the first engagement section 13B and, accordingly, can be increased. This means that, the axis 42A (fulcrum) of the hammer member 40 can be located closer to a player than in the conventional configuration, with respect to a same key stroke as that in the conventional configuration (a prescribed vertical travel range of an acting point). Furthermore, a ratio between the distance from the axis 42A to the rear end of the hammer member 40 and that from the axis 42A to the acting point can be increased. This contributes to giving a solid massive feel (resistance feel) even though the mass 41 can be reduced and, accordingly, the weight of the keyboard apparatus 100 with a mass 41 can be reduced.

Further in accordance with the keyboard apparatus 100 mentioned above, the black key unit 11 can be temporarily fixed to the key frame 20 by engaging the first engagement section 13B on the key supporting part 13 with the second engagement section 22E on the key frame 20 and thus the mounting work can be performed easily.

Further in accordance with the keyboard apparatus 100 described above, since the key supporting part 13 has a first screw hole 16, the key mounting part 22A has a boss 21 extending toward the key supporting part 13 and a second screw hole 21A on the boss 21, and the key supporting part 13 is locked to the key mounting part 22A by inserting the screw N into both the first screw hole 16 and the second screw hole 21A, the boss 21 can be prevented from projecting below the key mounting part 22A and, accordingly, space efficiency and the degree of freedom of mounting can be improved.

Further in accordance with the keyboard apparatus 100, as shown in FIG. 3, the key supporting part 13 of the white key unit 10 has a mating hole 15 to mate with the boss 21, and the key supporting part 13 of the white key unit 10 is pinched and locked between the key mounting part 22A and the key supporting part 13 of the black key unit 11. This contributes to easy positioning of the white key unit 10 with respect to the key frame 20 just by mating the mating hole 15 with the boss 21, which facilitates the mounting work. It would be better that the above-mentioned positioning should be kept within the range of the previous process to align the position of the three key units 10 and 11 with the widthwise direction Y3 and fix them to the key frame 20. Because the positioning in the depth direction Y1 has been completed by means of the positioning convex portion 13D and the positioning concave portion 13E. Otherwise, this positioning may be left to the boss 21 and the mating hole 15 in both the depth direction Y1 and the widthwise direction Y3, by easing the mating between the positioning convex portion 13D and the positioning concave portion 13E by securing a clearance or other means. Furthermore, since the length of the screw N can be reduced, the screw N can be standardized and, accordingly, production efficiency can be improved. Moreover, if the key frame 20 also serves as a instrument case, the boss 21, which is a drawback in the appearance, can be hidden behind the key supporting part 13 and thus, a neat appearance can be attained and the degree of freedom of design can be improved.

Further in accordance with the keyboard apparatus 100 described above, since the second reinforcement rib 24 is positioned in the gap S between the key supporting part 13 and connecting part 14 of one white key unit 10 and those of another white key unit 10 placed next to it, the second reinforcement rib 24 is prevented from projecting below the key mounting part 22A. Thus the second reinforcement rib 24 is prevented from projecting below the key mounting part 22A and thus, the space underneath the key mounting part 22A can be used effectively, which is exemplified by providing an after-touch sensor 60 or increasing the reciprocating range of the mass 41.

Further in accordance with the keyboard apparatus 100 described above, since cutouts 12E and 12F are provided in the section covered with the panel 30 of the key body 12, the gap S is extended toward the player side in the depth direction Y1, and the second reinforcement rib 24 is provided so that it is positioned also in the gap S provided by the cutouts 12E and 12F, the second reinforcement rib 24 can be increased in size, so that the reinforcement of the key mounting part 22A can be further strengthened.

Figure 4:
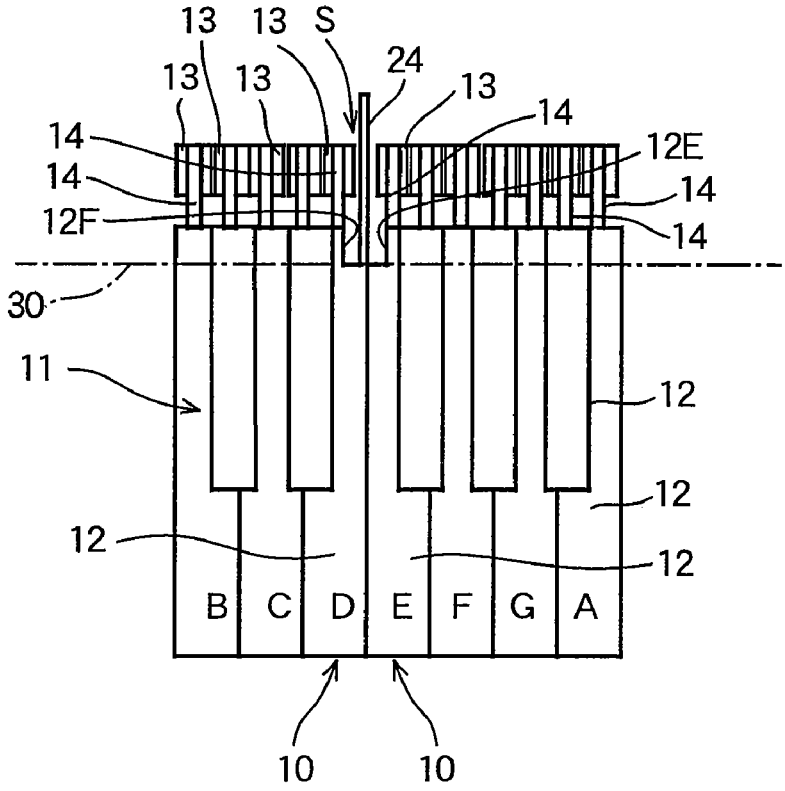
FIG. 4 is a top view of a keyboard apparatus according to another embodiment, with the panel excluded.

In the first embodiment described above, a plurality of key bodies 12 are provided for each key supporting part 13, however, the present invention needs not be limited to such application. It may be applied in such a way that a single key body 12 is provided for each key supporting part 13, as shown in FIG. 4, for example. In this case, a second reinforcement rib 24 may be positioned in the gap S between the key supporting part 13, connecting part 14 and key body 12 of one white key unit 10 and those of another white key unit 10 placed next to it in the widthwise direction Y3.

Figure 5:
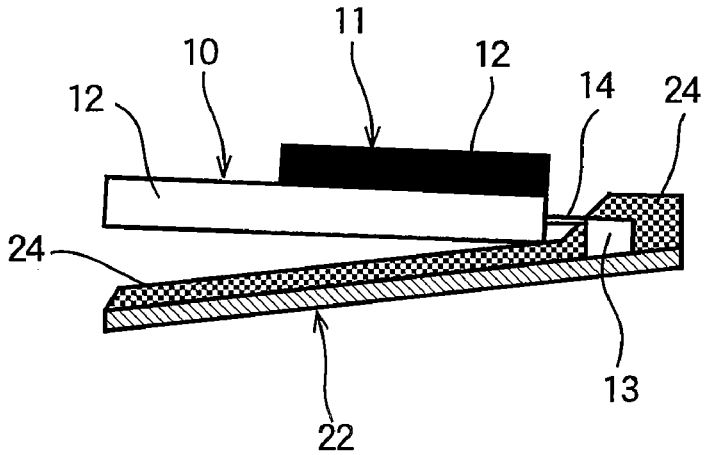
FIG. 5 is a partial cross-sectional view of a keyboard apparatus according to another embodiment.

In the first embodiment described above, there is no second reinforcement rib 24 below the key body 12, however, the present invention needs not be limited to such application. It may be applied in such a way that a second reinforcement rib 24 may also be provided below the key body 12 to further strengthen the key mounting part 22A, as shown in FIG. 5, for example.

Figure 6:
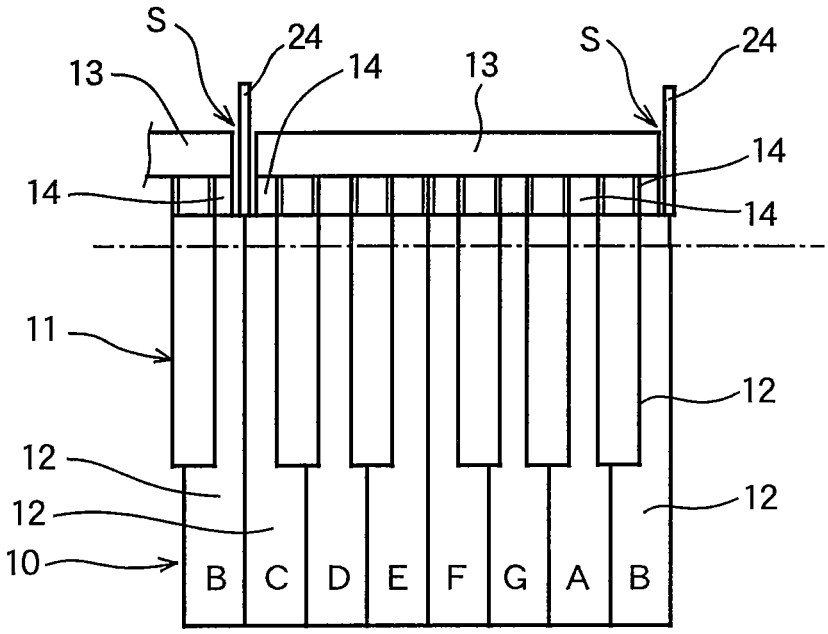
FIG. 6 is a top view of a keyboard apparatus according to another embodiment, with the panel excluded.
Figure 7:
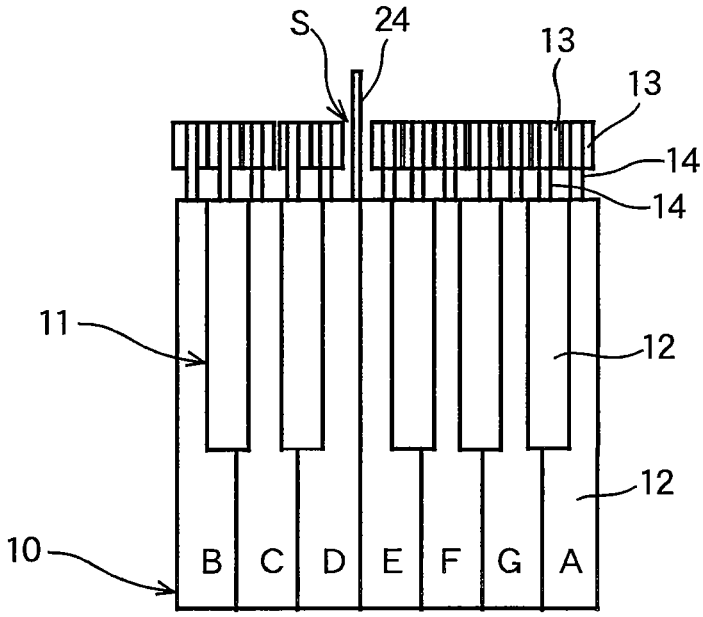
FIG. 7 is a top view of a keyboard apparatus according to another embodiment, with the panel excluded.

In the first embodiment described above, cutouts 12E and 12F are provided in the key body 12 and a second reinforcement rib 24 is also positioned in the gap S created by the cutouts 12E and 12F, however, the present invention needs not be limited to such application. It may be applied in such a way that, if there is no problem in the strength of the key mounting part 22A, there may be no cutouts 12E and 12F in the key body 12, and a second reinforcement rib 24 may be positioned only in the gap S between the key supporting part 13 and the connecting part 14, as shown in FIGS. 6 and 7, for example.

In the first embodiment described above, a second reinforcement rib 24 is positioned in a gap S between the key supporting part 13, connecting part 14 and key body 12 of one white key unit 10 and those of another white key unit 10 placed next to it, however, the present invention needs not be limited to such application. It may be applied in such a way that a second reinforcement rib 24 may be provided at the farther side away from a player in the depth direction Y1 than the key mounting part 22 on the upper surface portion 22, for example. In this case, however, a stopper SD should be provided below the second reinforcement rib 24.

In the first embodiment described above, the space underneath the key mounting part 22A is effectively used by providing an after-touch sensor 60 or a mass 41 in the space underneath the key mounting part 22A, however, the present invention needs not be limited to such application. It may be applied in such a way that the space underneath the key mounting part 22A is used fro positioning various kinds of functional component such as speaker SP in the space underneath the key mounting part 22A, for example, as the second embodiment below.

Second Embodiment

Figure 8:
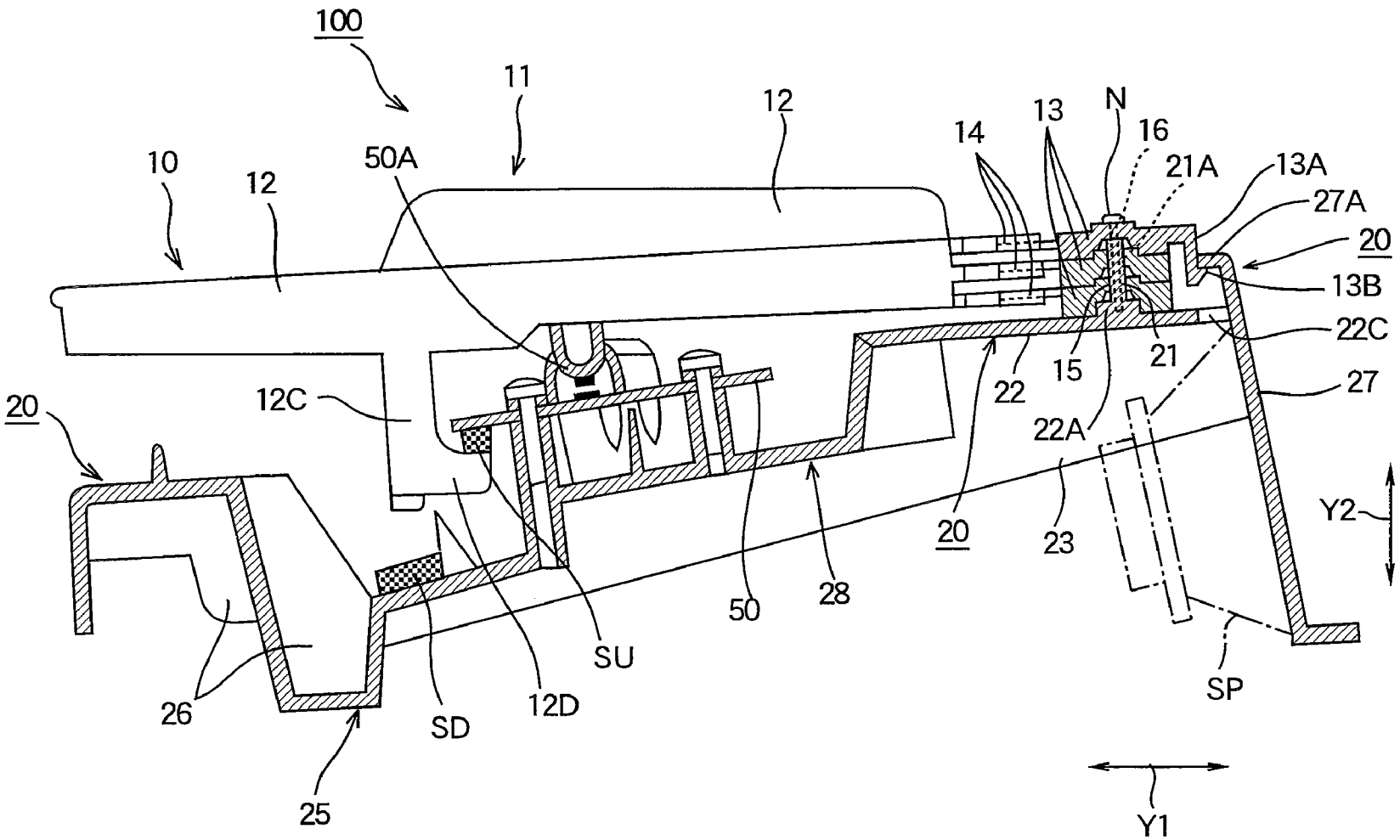
FIG. 8 is a cross-sectional view showing the second embodiment of a keyboard apparatus of the present invention.
Figure 9:
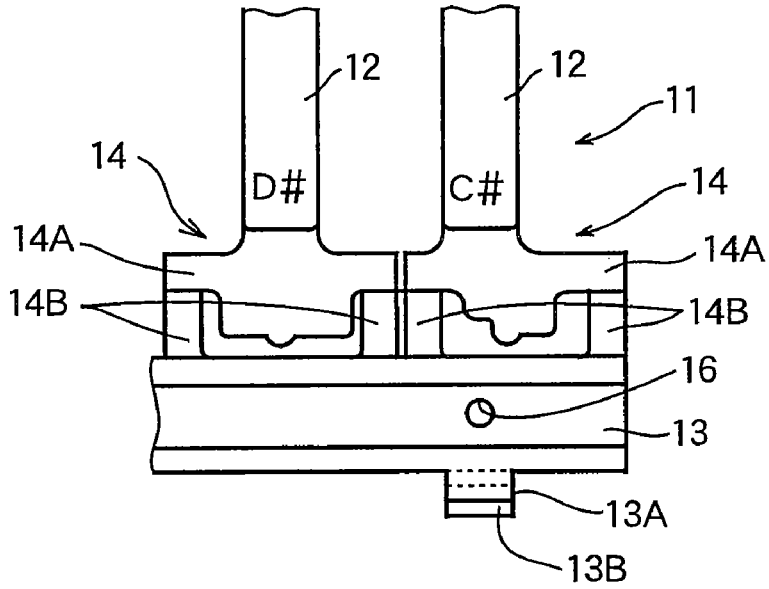
FIG. 9(A) is a partial top view of the black key unit constituting the keyboard apparatus as shown in FIG. 8.
FIG. 9(B) is a partial top view of the black key unit and the key frame constituting the keyboard apparatus as shown in FIG. 8.
Figure 9:
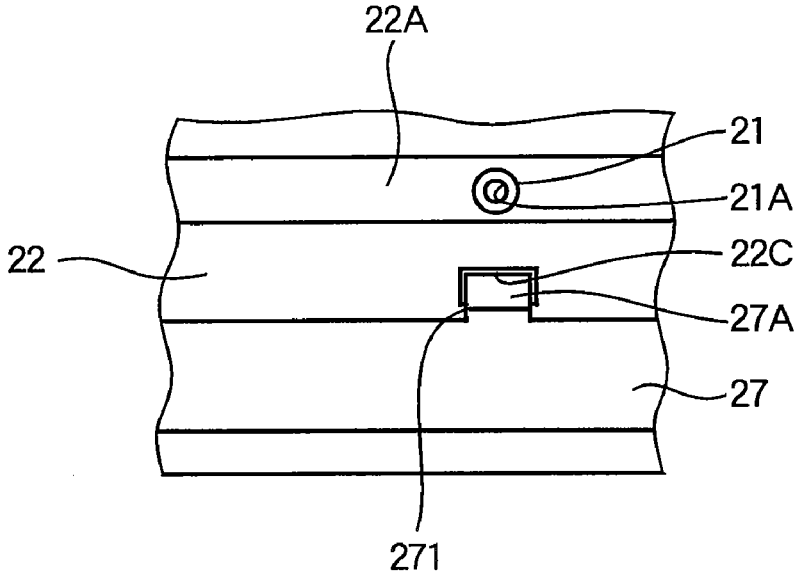

Next described below is the second embodiment of the present invention, referring to the drawings. FIG. 8 is a cross-sectional view showing the second embodiment of a keyboard apparatus 100 of the present invention. FIG. 9(A) is a partial top view showing the black key unit 11 constituting the keyboard apparatus 100 shown in FIG. 8. FIG. 9(B) is a partial top view of the black key unit 11 and the key frame 20 constituting the keyboard apparatus 100 shown in FIG. 8. In FIGS. 8 and 9, the parts common to those described in the first embodiment described above referring to FIGS. 1 through 3 are given the same numerals, respectively, and the detailed description of such parts are omitted.

A keyboard apparatus 100 comprises a white key unit 10 and black key unit 11, and a key frame 20. The second embodiment differs greatly from the first embodiment in the point that it does not comprise a hammer member 40. Both the white key unit 10 and black key unit 11 are provided with one or more of key body 12, a key supporting part 13 and a connecting part 14, which are provided integrally by means of synthetic resin, similarly to those in the first embodiment. In the second embodiment, the connecting part 14 is constituted by a horizontal wide section 14A wider than that of the key body 12 and a pair of plate-like thin hinge sections 14B connecting to both ends of the wide section 14A, and the other ends of the pair of thin hinge sections 14B connect to the key supporting part 13. This contributes to controlling the runout of the key body 12 in the widthwise direction, and thus enables the key body 12 to be vertically reciprocated at a constant position as if so-called key guides are provided, even if there is no key guides. Please note that, for the clarity of the drawing, the structure of the connecting part 14 is shown of only one white key unit 10 in FIG. 9(A), however, other white key units 10 and black key units 11 have the same structure as that, respectively.

The key body 12 comprises a leg section 12C extending toward the lower side of the key-stroking direction Y2, and a stopper strip 12D provided at the end of the lower side of the key-stroking direction Y2 of the leg section 12C and extending toward the farther side from a player in the depth direction Y1. When the key body 12 is pressed down, the lower side of the leg section 12C is brought into contact with a stopper member SD (made of felt or the like) on the key frame 20; while, when the key body 12 is released, the upper side of the stopper strip 12D is brought into contact with a stopper member SU on the key frame 20 to control the reciprocating range of the key body 12. The detailed description of the key body 12, key supporting part 13 and connecting part 14, which are the same as those in the first embodiment described above, is omitted.

The key frame 20 is provided with a top surface portion 22, a first reinforcement rib 23, a front section 25, a third reinforcement rib 26, a rear wall section 27 and a basal plate mounted section 28, which are provided integrally by means of synthetic resin. The detailed description of the upper surface portion 22, front section 25 and third reinforcement rib 26, which are the same as those in the first embodiment described above, is omitted here. The first reinforcement rib 23 is provided on the lower side of the key-stroking direction Y2 of the upper surface portion 22 and basal plate mounting section 28 to strengthen them.

The rear wall section 27 is provided to have a plate-like shape approximately perpendicular to the depth direction Y1, and provided on the farther side away from a player in the depth direction Y1 of the upper surface portion 22. The opposing portion 271 facing the first engagement section 13B of the rear wall section 27 is provided so that its upper end in the key-stroking direction Y2 is extending above the key mounting part 22A slightly extending from the upper surface portion 22, and its upper end is provided with a second engagement section 27A extending toward a player in the depth direction Y1 of the key frame.

The opposing portion facing the second engagement section 27A of the upper surface 22 has a hole 22C for the prevention of undercut of the second engagement section 27A. This hole 22C serves to prevent interference between the upper surface portion 22 and the first engagement section 13B when the first engagement section 13B engages with the second engagement section 27A. The arm section 13A and first engagement section 13B of the black key unit 11 are provided at two locations corresponding to the C# key and A# key for each key unit of one octave, and the second engagement section 27A on the key frame 20 side is also located, respectively, at a position corresponding to the first engagement section 13B.

The basal plate mounting section 28 is provided between the upper surface portion 22 and the front section 25. The basal plate mounted section 28 is located below the upper surface portion 22 and provided with a basal plate 50 having a key switch 50A on it.

Next, the mounting of the key units 10 and 11 to the key frame 20 is described of the keyboard apparatus 100 having the configuration described above. First, a boss 21 on the key frame 20 is mated with the mating holes 15 on the key supporting parts 13 of two white key units 10 in this order. The first engagement section 13B on the key supporting part 13 of the black key unit 11 is engaged with a second engagement section 27A on the rear wall section 27 to temporarily lock the black key unit 11 to the key frame 20. This temporary fixation causes a first screw hole 16 on the key supporting section 13 of the black key unit 11 to be aligned with a second screw hole 21A on the boss 21. Then a screw N is inserted into both the first screw hole 16 and the second screw hole 21A to lock the key units 10 and 11 to the key frame 20.

In accordance with the second embodiment described above, since the first engagement section 13B on the key supporting part 13 and the second engagement section 27A on the key frame 20 are located above the key mounting part 22A, the first engagement section 13B on the key supporting part 13 is prevented from being located below the key mounting part 22A. Thus, similarly to that in the first embodiment, the first engagement section 13B is prevented from projecting below the key mounting part 22A, various kinds of functional parts such as speaker SP can be positioned below the key mounting part 22A.

As described above, the key supporting part 13 has the first engagement section 13B. The key mounting part 22A has the second engagement section 27A comprised of a projection provided on the upper surface of the key frame and extending toward the key supporting part and a second hole provided on the projection. The locking member N couples the first engagement section 13B and the second engagement section 27A with each other to lock the key supporting part 13 and the key mounting part 22A with each other.

In accordance with the second embodiment described above, the black key unit 11 can be temporarily locked to the key frame 20 by engaging the first engagement section 13B on the key supporting part 13 with the second engagement section 27A on the key frame 20, thereby facilitating the mounting work, similarly to that in the first embodiment.

In the second embodiment described above, the space underneath the key mounting part 22A is effectively used by positioning various kinds of functional parts such as speaker SP below the key mounting part 22A, however, the present invention needs not be limited to such application, for example, similarly to the first embodiment. It may be applied in such a way that the space underneath the key mounting part 22A may be effectively used by providing an after-touch sensor 60 or a mass 41 in the space underneath the key mounting part 22A.

In the first and second embodiments described above, the key units 10 and 11 are temporarily fixed to the key frame 20 by engaging the first engagement section 13B with the second engagement sections 22E and 27A, and then firmly fixed by means of the screw N, however, the present invention needs not be limited to such application. It may be applied in such a way that the key unites 10 and 11 may be firmly fixed to the key frame by engaging the first engagement section 13B with the second engagement section 22E and 27A, without performing fixation by means of the screw N, as shown in FIG. 10.

Figure 10:
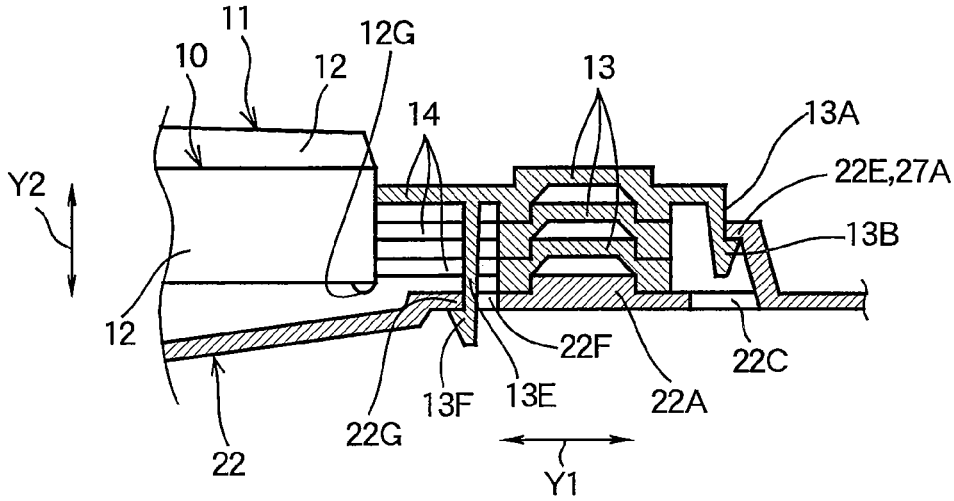
FIG. 10 is a partial enlarged view in the vicinity of the key supporting part and the key mounting part of a keyboard apparatus according to another embodiment.

As shown in FIG. 10, the key supporting part 13 of the black key unit 11 is provided with an arm section 13E provided on the player side in the depth direction Y1 and extending toward the lower side of the key-stroking direction Y2 and a third engagement section 13F provided at the lower end in the key-stroking direction of the arm section 13E and extending toward the player side in the depth direction Y1. The upper surface portion 22 of the key frame 20 has an insertion hole 22F into which the third engagement section 13F is inserted. Inserting the third engagement section 13F into the insertion hole 22F engages the third engagement section 13F with a fourth engagement section 22G located at the edge of the player side of the insertion hole 22F. This causes the player side as well as the farther side from the player in the depth direction Y1 of the key supporting part 13 to be engaged with the key frame 20, thereby making firm fixation only by means of the engagement sections 13A and 13F without using the screw N.

Figure 11:
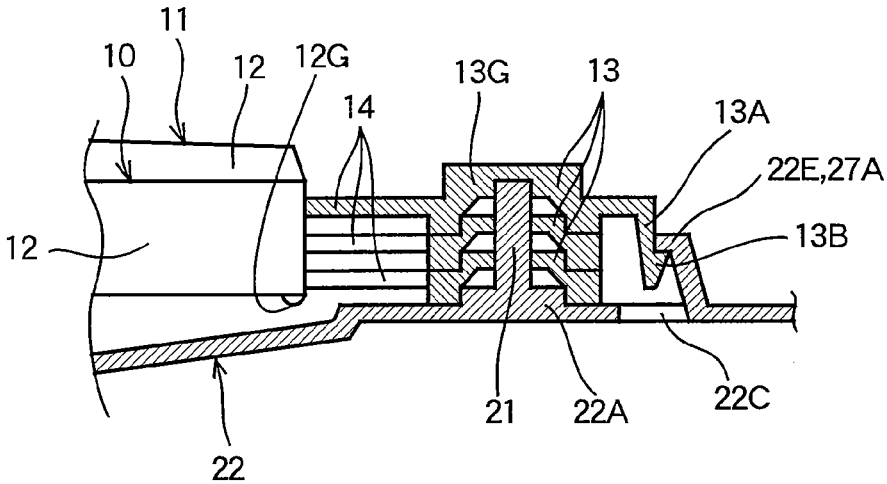
FIG. 11 is a partial enlarged view in the vicinity of the key supporting part and the key mounting part of a keyboard apparatus according to another embodiment.

As shown in FIG. 11, the key units 10 and 11 may be firmly fixed to the key frame 20 by engaging the first engagement section 13B with the second engagement sections 22E and 27A without performing fixation by the screw N.

As shown in FIG. 11, the key mounting part 22A has a boss 21 extending toward the key supporting section 13. The lower side of the key supporting part 13 of the black key unit 11 has a concave portion 13G having a concavity on the upper side. Mating the boss 21 with the concave portion 13G to lock the key supporting part 13 and the key mounting part 22A can firmly fix them just by means of the first engagement section 13B and the concave portion 13G without using a screw N.

In such a case as shown in FIG. 11, the boss 21 can be prevented from projecting below the key mounting part 22A, thereby improving space efficiency and the degree of freedom of mounting.

In the example as shown in FIG. 11, the key supporting part 13 has a concave portion 13G, into which the boss 21 is mated with, however, the present invention needs not be limited to such application. It may be applied in such a way that the key supporting part 13 of the black key unit 11 may be provided with a mating through-hole in the key-stroking direction Y2 and the boss 21 may be mated with the mating hole.

Figure 12:
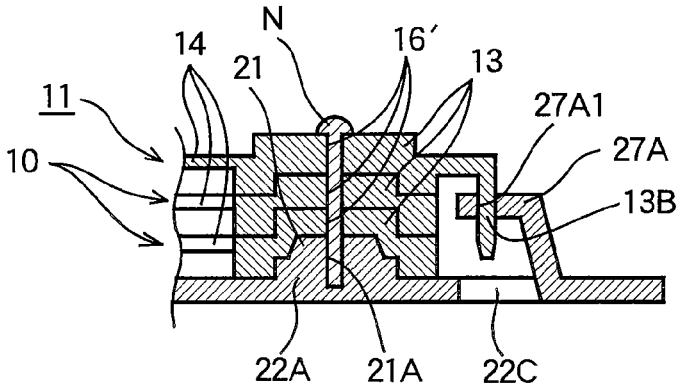
FIG. 12 is a partial enlarged view in the vicinity of the key supporting part and the key mounting part of a keyboard apparatus according to another embodiment.

In the first and second embodiments, the second engagement sections 27A and 22E are formed by contact strips extending from the vertical wall section 22D and the rear wall section 27, and the contact strips are brought into contact with each other, however, the present invention needs not be limited to such application. It may be applied in such a way that, as shown in FIG. 12, the second engagement section 27A may be formed as an engagement section having a through-hole 27A1, and the first engagement section 13B formed in press-fitting structure may be press-fitted into the through-hole 27A1. The press-fitting structure of the first engagement section 13A enables the first engagement section 13A to be press-fitted into the through-hole 27A1 provided on the second engagement section 27A, which is provided in a rod-like shape in the embodiment as shown in FIG. 12, with its end portion tapered toward the tip. In the embodiment as shown in FIG. 12, the second engagement section 27A has a through-hole 27A1, however, a concave portion may be provided instead of the through-hole 27A1, so that the first engagement section 13A may be press-fitted into the concave portion.

In the first and second embodiments described above, the key supporting part 13 of the white key unit 10 has a mating hole 15 and the boss 21 is mated with the mating hole 15, however, the present invention needs not be limited to such application. It may be applied in such a way that, as shown in FIG. 12, the key supporting part 13 may respectively have a screw insertion hole (unloaded hole) 16', the two white key units 10 and the black key unit 20 may be laid on the boss 21 in the order as shown in the figure, with the screw N inserted into the screw insertion holes 16', so that they can be threadably mated with the screw 21A and locked to the key mounting part 22A. In this case, the positioning of the key units 10 and 11 to the key frame 20 is made with the through-hole 27A1 and the projection of the first engagement section 13B.

In the first and second embodiments, the screw N is used as a locking member, however, the present invention needs not be limited to such application. It may be applied in such a way that the locking member may be press-fitted into both the first hole (first screw hole) on the key supporting part 13 and the second hole (second screw hole) on the key mounting part 22A to lock the key supporting part 13 to the key mounting part 22A. Generally, the locking member comprises a screw, a hook or both of the screw and hook.

The embodiments described above suggest only the typical modes of the present invention and the application of the present invention may not be limited to the suggested embodiments. Therefore, one ordinarily skilled in the art can made various changes and modifications to the present invention without departing from the spirit and scope of the present invention.

Third Embodiment

Figure 13:
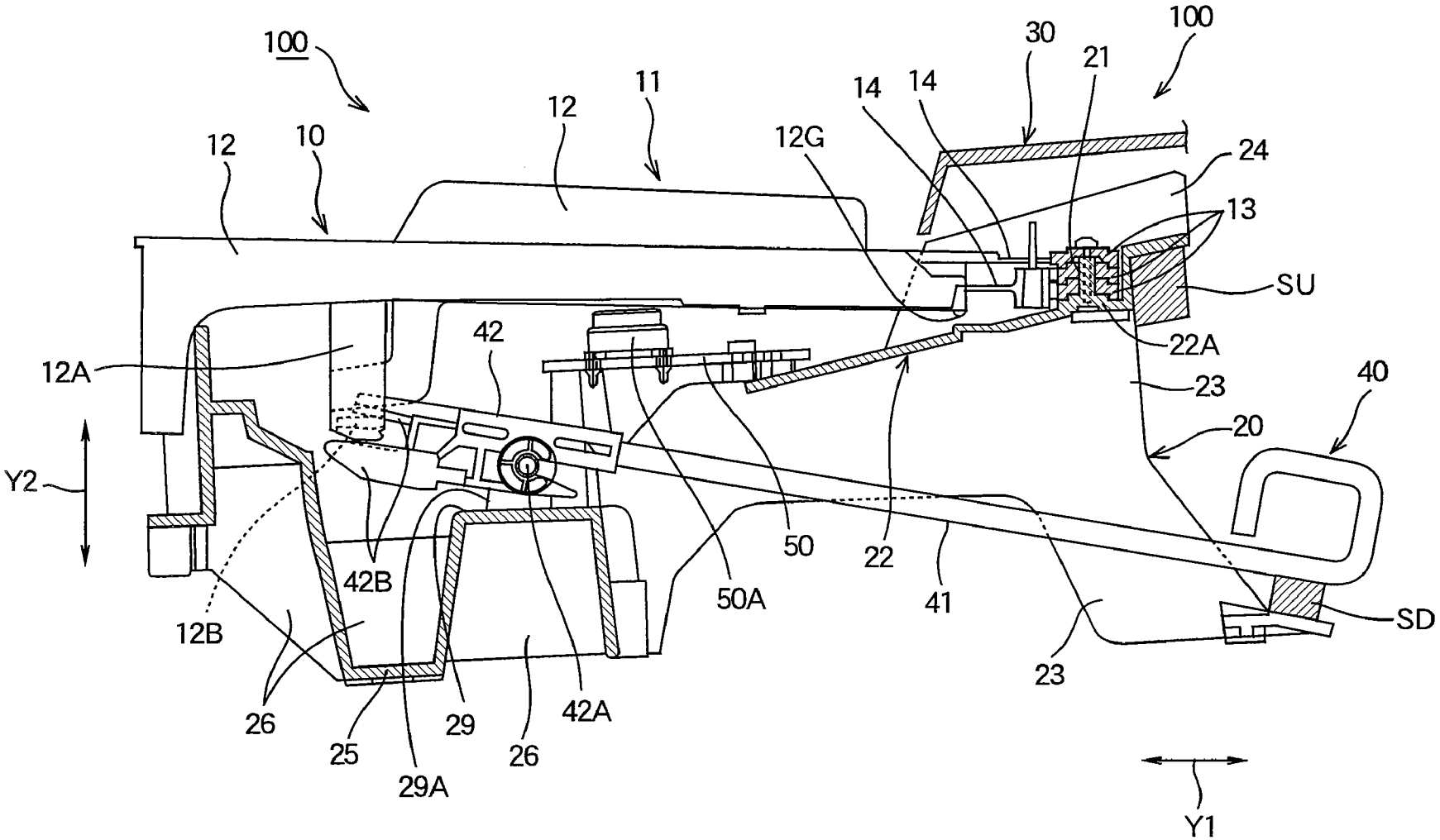
FIG. 13 is a cross-sectional view showing the third embodiment of a keyboard apparatus of the present invention.
Figure 14:
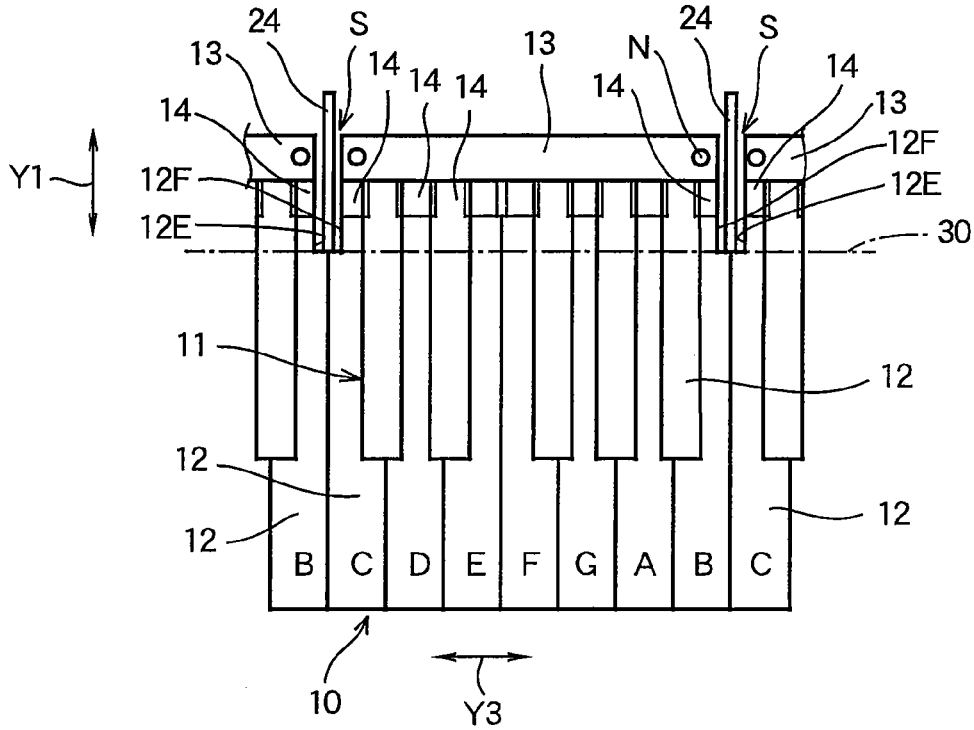
FIG. 14 is a top view of the keyboard apparatus as shown in FIG. 13, with the panel excluded.
Figure 15:
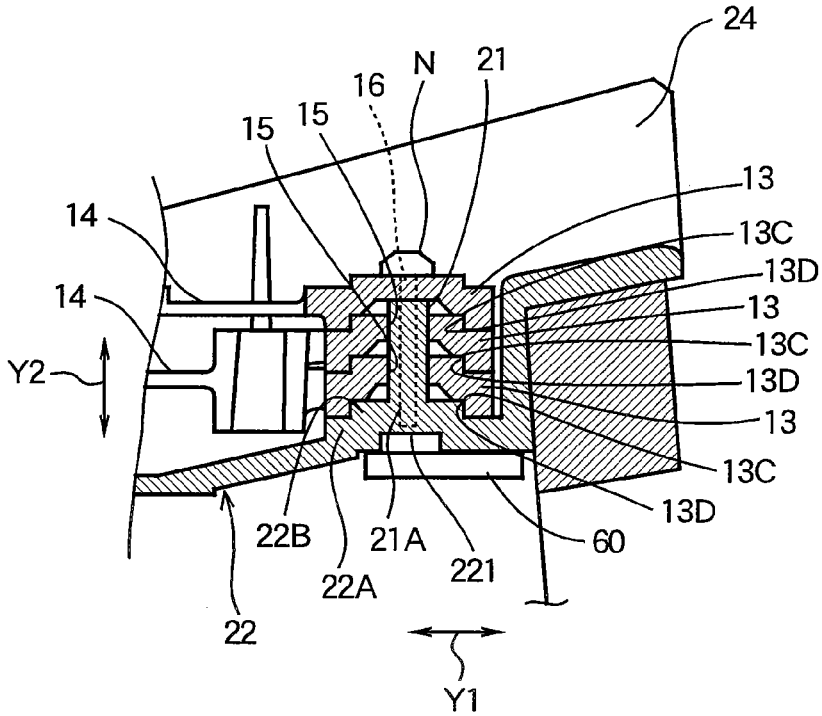
FIG. 15 is a partial enlarged view in the vicinity of the key supporting part and the key mounting part as shown in FIG. 13.

Described below is a third embodiment of the present invention, referring to the drawings. FIG. 13 is a cross-sectional view showing the third embodiment of a keyboard apparatus 100 of the present invention. FIG. 14 is a top view of the keyboard apparatus 100 shown in FIG. 13, with panel 30 excluded. FIG. 15 is a partial enlarged view in the vicinity of the key supporting part 13 and key mounting part 22A of the keyboard apparatus 100 shown in FIG. 13.

A keyboard apparatus 100, whose example is an electronic keyboard instrument, comprises a white key unit 10 and a black key unit 11 serving as key units, a key frame 20 formed of hard synthetic resin, and a hammer member 40, and a panel 30 is provided above the key frame as well as in the rear of the keyboard apparatus 100.

The white key unit 10 and black key unit 11 are, respectively, provided with one or more of key body 12 for undergoing stroking operation, a key supporting part 13 supporting the farther side of the key body away from a player in a depth direction Y1 of the key body 12, and a connecting part 14 connecting the key body 12 to the key supporting part 13 pivotably in a key-stroking direction Y2. These parts are provided integrally by means of synthetic resin.

The key body 12 is provided with a stopper projection 12G at the lower surface of the rear end of the key body. This stopper projection 12G is provided for preventing the connecting part 14 having hinge structure from breaking, should the key body 12 be pressed strongly or should a younger child lean on the key body 12. The key supporting part 13 is provided in a lengthy form with its longitudinal direction extending along a widthwise direction Y3, as shown in FIG. 14, and respective key units 10 and 11 are provided as a common base shared by keys in a common manner. As shown in FIG. 15, the key supporting part 13 has a positioning convex portion 13C on the upper side and a positioning concave portion 13D on the lower side. The positioning convex portion 13C and the positioning concave portion 13D are provided so that the positioning convex portion 13C provided on the lower side of the key supporting part 13 is fit into the positioning concave portion 13D provided on the upper side of another key supporting part 13 when a plurality of key supporting parts 13 are superposed each other in the key-stroking direction Y2. The positioning convex portion 13C and the positioning concave portion 13D facilitate the positioning between the key supporting parts 13. As shown in FIG. 13, the connecting part 14 is positioned between the key body 12 and the key supporting part 13, and is designed to be thin and to have elasticity, to constitute a hinge structure.

The keyboard apparatus 100 has two white key units 10 and one black key unit 11 per octave. In one of the two white key units 10, a single key supporting part 13 supports three key bodies 12 covering each note of D, F and A. In the remaining one of the two white key units 10, a single key supporting part 13 supports four key bodies 12 covering each note of C, E, G and B. In the black key unit 11, a single key supporting part 13 supports five key bodies 12 covering notes of C#, D#, F#, G# and A#.

These two white key units 10 and one black key unit 11 constitute one octave of keys with their key supporting parts 13 stacked on each other in the key-stroking direction Y2. A plurality of this one octave keys are arranged in the widthwise direction Y3 of the key frame. The key bodies 12 for C and B notes have cutouts 12E and 12F for creating a gap S between the key supporting part 13 and connecting part 14 of one white key unit 10 and those of another white key unit 10 placed next to it in the widthwise direction Y3. The gap S extends in the depth direction Y1 toward a player side. The key supporting parts 13, connecting parts 14 and the cutouts 12E and 12F are covered with a panel 30 provided on the upper surface side and thus not seen from the front.

As shown in FIG. 15, the white key units 10, respectively, have a mating hole 15 into which a boss 21 on the key frame 20, which is described later, is fit. On the contrary, the black key unit 11 has a first screw hole 16 into which a screw N serving as a locking member which is smaller than the mating hole 15 is inserted. Any or both of these mating hole 15 and screw hole 16 corresponds (or correspond) to a first hole as set forth in the claims.

The key frame 20 is mounted on the lower case not shown. Or the frame 20 itself may constitute a lower case. This key fame 20 has a upper surface portion 22, a first reinforcement rib 23 integrally formed along the depth direction Y1 below the upper surface portion 22, a second reinforcement rib 24 formed above the upper surface portion 22, a front section 25 and a third reinforcement rib 26, by means of synthetic resin. The upper surface portion 22 is provided to have a plate-like shape approximately perpendicular to the key-stroking direction Y2 and located on the farther side remote from a player in the depth direction Y1 and upper side of the key-stroking direction Y2. The upper surface portion 22 is provided in a tapered shape where, the closer to the player side in the depth direction Y1, the closer to the lower side it becomes.

The farther side remote from a player in the depth direction Y1 of the upper surface portion 22 has a key mounting part 22A to which the key supporting part 13 is locked. The key mounting part 22A has a positioning convex portion 22B and a boss 21 provided on the positioning concave portion 22B, as shown in FIG. 15. The positioning convex portion 22B is provided so that it is fit into the positioning concave portion 13D when the key supporting part 13 is laid on the key mounting part 22A. The positioning convex portion 22B and the positioning concave portion 13D facilitate the positioning of the key supporting part 13 to the key mounting part 22A.

The above-mentioned boss 21 is provided, extending toward the upper side of the key-stroking direction Y2 of the key mounting part 22A, that is, toward the key supporting part 13. The boss 21 has a second screw hole 21A, which serves as a second hole into which a screw N described later is inserted. The second screw hole 21A has a thread groove to threadably mate with the screw N.

The lower surface of the key mounting part 22A is provided to have a plate-like shape having a concave groove 221 in the widthwise direction Y3. The lower surface of the key mounting part 22A is provided with a after-touch sensor 60. The after-touch sensor 60 serves as a sensor detecting a striking pressure when the key body 12 is further pressed down after a normal key pressing, and is constituted by a resistor board having a resistor pattern with its resistance varying according to the pressure, a conductor board having a conductor pattern to be connected to the resistor pattern and a felt, which are laid on each other in this order. The sensor 60 detects contact pressure by bringing into contact with the key body by means of the mass 41 of a hammer member 40 when a key is pressed.

The first reinforcement rib 23 supports the lower side of the key-stroking direction Y2 of the upper surface portion 22 and reinforces the upper surface portion 22. The first reinforcement rib 23 is provided to have a plate-like shape approximately perpendicular to the widthwise direction Y3 and a plurality of the same ribs are arranged along the widthwise direction Y3 (for example, between B and C keys).

The second reinforcement rib 24 serves as a reinforcement rib for reinforcing the upper surface portion 22. As shown in FIG. 14, the second reinforcement rib 24 is provided, extending toward the upper side of the key-stroking direction Y2 from the upper surface portion 22, so as to be positioned in a gap S between the key supporting part 13, connecting part 14 and key body 12 of one white key unit 10 and those of another white key unit 10 placed next to it. The second reinforcement rib 24 is provided to have a plate-like shape approximately perpendicular to the widthwise direction Y3 and a plurality of them are placed along the widthwise direction Y3.

The front section 25 is provided on the player side in the depth direction Y1 and at the lower side of the key-stroking direction Y2, and its cross-section has concave and convex surfaces. A third reinforcement rib 26 reinforces the front section 25. The third reinforcement rib 26 is provided to have a plate-like shape approximately perpendicular to the widthwise direction Y3, and a plurality of them are arranged along the widthwise direction Y3.

As shown in FIG. 13, the hammer member 40 is constituted by a mass 41 extending in the depth direction Y1 and a basal section 42 retaining the end of the mass 41, and is supported by a fulcrum supporting section 29A provided above the central convex portion 29 of the key frame 20. At the tip of the basal section 42, a connecting strip 42B splitting into upper and lower direction is formed, and mated with a connecting plate 12B provided at the lower end of the acting section 12A projecting toward the lower side from the key body 12.

When a key body is pressed, the acting section 12A pushes down the basal section 42 and the hammer member 40 rotates counterclockwise in FIG. 13 around the rotating axis 42A; while, when a key body is released, the acting section 12A pushes up the basal section 42 and the hammer member 40 rotates clockwise in FIG. 13 around the axis of rotation 42A. This contributes to giving a touch feeling like an acoustic piano. The key frame 20 is provided with stoppers SD and SU made of felt at the lower end portion and the upper end portion of the key frame, and these stoppers SD and SU serve to limit the rotating range of the hammer member 40.

A basal plate 50 is arranged between the white key units 10 and black key unit 11 and the hammer member 40, and a key switch 50A which is turned on/off when a key body 12 is released is mounted on the key switch 50A.

Next, described below is the mounting of the key units 10 and 11 to the key frame 20 in the keyboard apparatus 100 mentioned above. First, the boss 21 on the key frame 20 is mated with the mating hole 15 in the key supporting part 13 of the white key unit 10 consisting of four key bodies 12 covering each note of C, E, G and B and then that of the white key unit 10 consisting of three key bodies 12 covering each note of D, F and A in this order.

At this time, as shown in FIG. 15, the positioning concave portion 13D on the key supporting part 13 of the lower white key unit 10 is mated with the positioning convex portion 22B on the key mounting part 22A, and the positioning concave portion 13D on the key supporting part 13 of the upper white key unit 10 is mated with the positioning convex portion 13C of the key supporting part 13 of the lower white key unit 10, so that the white key units 10 are positioned at the key mounting part 22A.

The key supporting part 13 of the black key unit 11 is laid on the key supporting part 13 of the white key unit 10 so that the positioning convex portion 13C provided on the key supporting part 13 of the upper white key unit 10 is fit into the positioning concave portion 13D provided on the key supporting part 13 of the black key unit 11. This aligns the second screw hole 21A provided on the boss 21 with the first screw hole 16 provided on the black key unit 11. Then the screw N is inserted into both the first screw hole 16 and the second screw hole 21A to lock the key supporting part 13 and the key mounting part 22A with each other.

In accordance with the keyboard apparatus 100 described above, since the key supporting part 13 has the first screw hole 16, the key mounting part 22A has a boss 21 extending toward the key supporting part 13 and a second screw hole 21A provided on the boss 21, and the screw N is inserted into both the first screw hole 16 and the second screw hole 21A to lock the key supporting part 13 and the key mounting part 22A, the boss 21 is prevented from projecting below the key mounting part 22A, and space efficiency as well as the degree of freedom of mounting can be improved. Specifically, since the boss 21 is prevented from projecting below the key mounting part 22A, an after-touch sensor 60, for example, can be arranged on the lower surface of the key mounting part 22A, as shown in FIG. 13.

In addition, when a mass 41 is located at the lower side of the key mounting part 22A, as shown in FIG. 13, the reciprocating range of the mass 41 is not restricted by the key mounting part 22A, accordingly, can be increased. This means that, the axis 42A (fulcrum) of the hammer member 40 can be located closer a player than in the conventional configuration, with respect to a same key stroke as that in the conventional configuration (a prescribed vertical travel range of an acting point). Furthermore, a ratio between the distance from the axis 42A to the rear end of the hammer member 40 and that from the axis 42A to the acting point can be increased. This contributes to giving a solid massive feel (resistance feel) even though the mass 41 can be reduced and, accordingly, the weight of the keyboard apparatus 100 with a mass 41 can be reduced.

Figure 16:
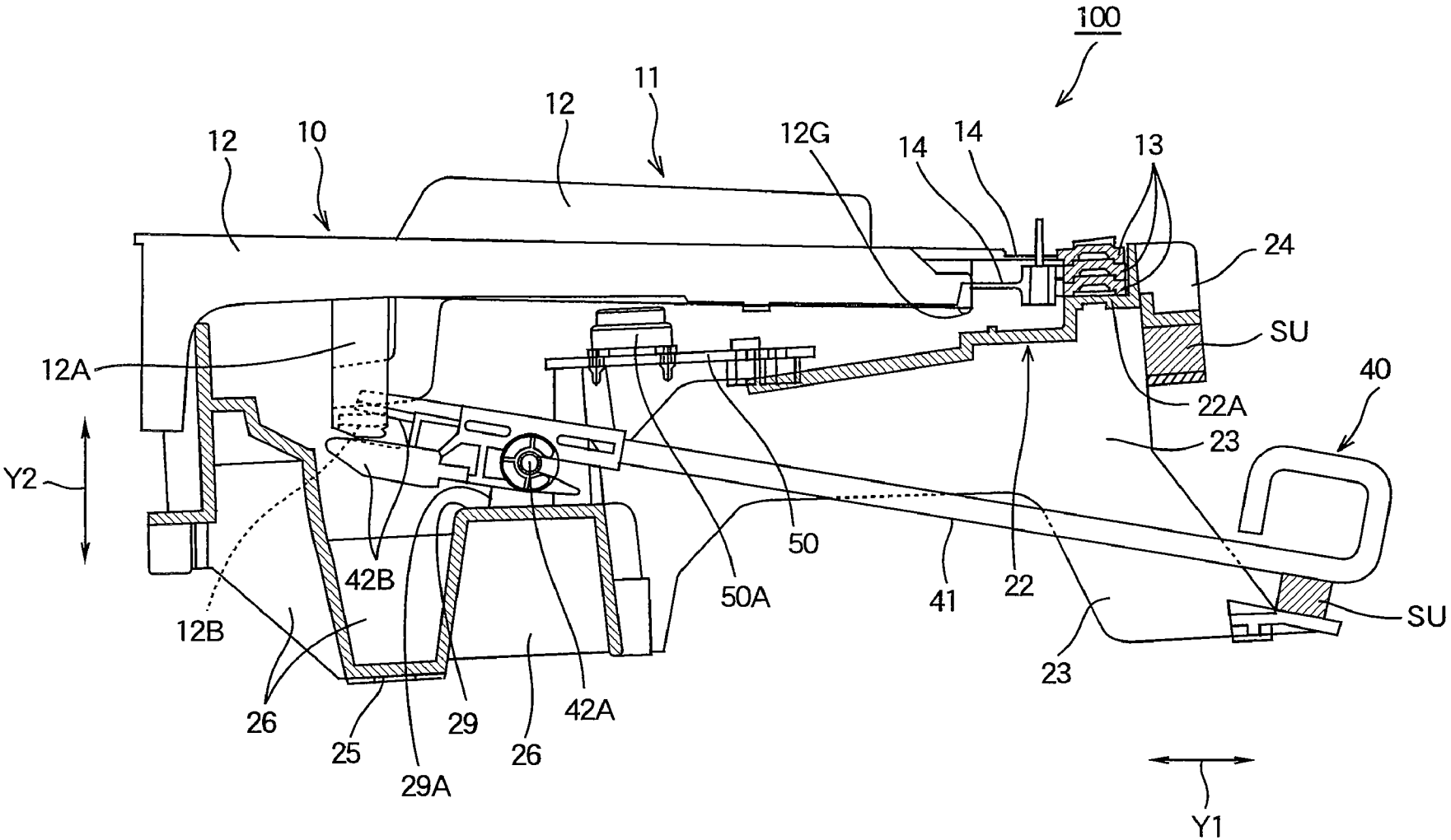
FIG. 16 is a cross-sectional view showing another embodiment of a keyboard apparatus of the present invention.
Figure 17:
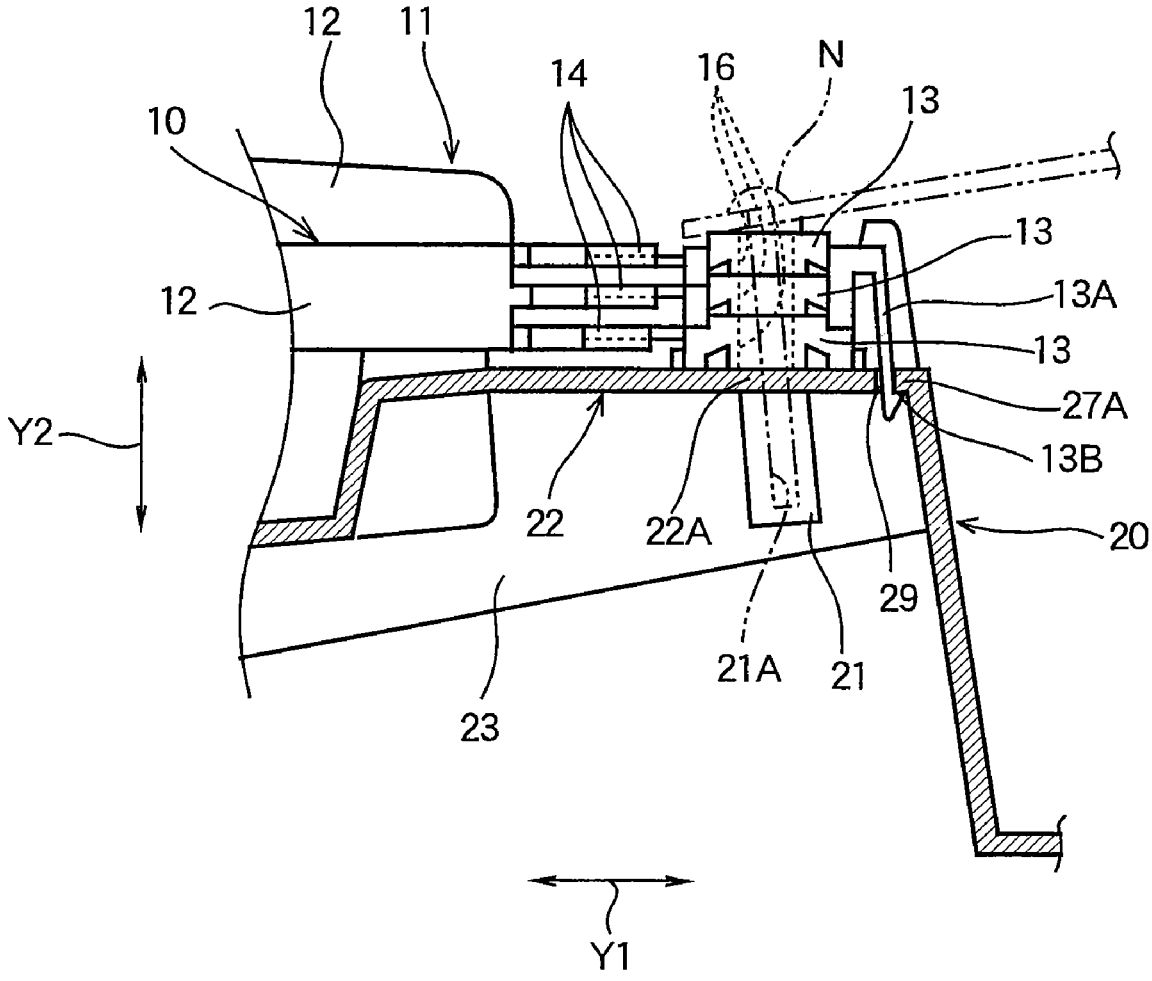
FIG. 17 is a partial cross-sectional view showing an example of a conventional keyboard apparatus.

In the third embodiment described above, the second reinforcement rib 24 is positioned in a gap S created between the key supporting part 13, connecting part 14 and key body 12 of the white key unit 10 and those of the white key unit placed next to it in the widthwise direction Y3, however, the present invention needs not be limited to such application. For example, as shown in FIG. 16, it may be applied in such a way that a second reinforcement rib 24 may be provided on the farther side from a player in the depth direction Y1 than the key mounting part 22A of the upper surface portion 22. In this case, however, a stopper SU should be provided below the second reinforcement rib 24.

What is claimed is:

1. A keyboard apparatus comprising:

a key unit that comprises one or more key bodies, a key supporting part for supporting each key body, and a connecting part for connecting the key body to the key supporting part pivotably in a key-stroking direction of the key body; and a key frame that comprises an upper surface, and a key mounting part disposed on the upper surface for locking the key supporting part of the key unit; wherein the key supporting part of the key unit has a first engagement section having a hook-like structure or a press-fitting structure;

the key mounting part of the key frame has a second engagement section which engages with the first engagement section when the key unit is mounted to the key frame, the second engagement section having a through-hole or a concave for engagement with the hook-like structure or the press-fitting structure of the first engagement section; and the first engagement section and the second engagement section are located above the key mounting part of the key frame.

2. The keyboard apparatus according to claim 1, wherein the key supporting part has a first hole;

the key mounting part has a projection provided on the upper surface of the key frame and extending toward the key supporting part, and a second hole provided on the projection; and a locking member is inserted into both the first hole and the second hole to lock the key supporting part and the key mounting part with each other.

3. The keyboard apparatus according to claim 1, wherein the key supporting part has a concave or a mating hole;

the key mounting part has a projection provided on the upper surface of the key frame and extending toward the key supporting part; and the projection is inserted into the concave or the mating hole to lock the key supporting part and the key mounting part with each other.

4. The keyboard apparatus according to claim 1, wherein a plurality of the key units are arranged in a widthwise direction of the key frame; and the key frame has a reinforcement rib which extends toward the key unit and which is positioned in a gap created between the key supporting parts of the key units adjacent to each other in the widthwise direction and also created between the connecting parts belonging to the adjacent key units.

5. The keyboard apparatus according to claim 1, wherein the key frame is provided with a stopper member disposed adjacent to the second engagement section of the key mounting part of the key frame for restricting a pivotal movement of a hammer member coupled to the key body.

6. A keyboard apparatus comprising:

a key unit that comprises one or more key bodies, a key supporting part for supporting each key body, and a connecting part for connecting the key body to the key supporting part pivotably in a key-stroking direction of the key body; and a key frame that comprises an upper surface, and a key mounting part disposed on the upper surface for locking the key supporting part of the key unit; wherein the key supporting part of the key unit has a first hole;

the key mounting part of the key frame has a projection provided on the upper surface of the key frame and extending toward the key supporting part, and a second hole provided on the projection; and a locking member is inserted into both the first hole and the second hole to lock the key supporting part and the key mounting part with each other.

7. The keyboard apparatus according to claim 6, wherein the key supporting part of the key unit has a first engagement section;

the key mounting part of the key frame has a second engagement section which engages with the first engagement section when the key unit is mounted to the key frame; and the first engagement section and the second engagement section are located above the key mounting part of the key frame.

8. The keyboard apparatus according to claim 7, wherein the key frame is provided with a stopper member disposed adjacent to the second engagement section of the key mounting part of the key frame for restricting a pivotal movement of a hammer member coupled to the key body.

9. The keyboard apparatus according to claim 6, wherein a plurality of the key units are arranged in a widthwise direction of the key frame; and the key frame has a reinforcement rib which extends toward the key unit and which is positioned in a gap created between the key supporting parts of the key units adjacent to each other in the widthwise direction and also created between the connecting parts belonging to the adjacent key units.

10. The keyboard apparatus according to claim 6, wherein the locking member comprises a screw, a hook or both of the screw and hook.

11. A keyboard apparatus comprising:

a key unit that comprises one or more key bodies, a key supporting part for supporting each key body, and a connecting part for connecting the key body to the key supporting part pivotably in a key-stroking direction of the key body; and a key frame that comprises an upper surface, and a key mounting part disposed on the upper surface for locking the key supporting part of the key unit; wherein the key supporting part of the key unit has a first engagement section;

the key mounting part of the key frame has a second engagement section comprised of a projection provided on the upper surface of the key frame and extending toward the key supporting part and a hole provided on the projection; and a locking member couples the first engagement section and the second engagement section with each other to lock the key supporting part and the key mounting part with each other.

* * * * *